United States Patent [19]

Nakahara et al.

[11] 4,129,008

[45] Dec. 12, 1978

[54] TREMIE TUBE

[75] Inventors: Yasushi Nakahara, Hackioji; Tadasuke Ohtomo, Hino; Shinichi Yokota, Chofu; Kazuo Usui, Kamisumachi, all of Japan

[73] Assignee: Kajima Kensetsu Kabushiki Kaisha, Tokyo, Japan

[21] Appl. No.: 689,690

[22] Filed: May 25, 1976

[30] Foreign Application Priority Data

May 28, 1975 [JP] Japan ..... 50-64688

[51] Int. Cl.[2] ..... E02D 15/06

[52] U.S. Cl. ..... 405/303; 251/5; 405/222; 405/233

[58] Field of Search ..... 61/53.52, 53.6, 53.64, 61/63, 100; 222/214, 528, 529; 251/5

[56] References Cited

U.S. PATENT DOCUMENTS

| | | | |
|---|---|---|---|
| 3,397,860 | 8/1968 | Bushmeyer | 251/5 X |
| 3,446,027 | 5/1969 | Meijer | 61/63 |
| 3,595,161 | 7/1971 | Webb | 61/100 X |
| 3,791,153 | 2/1974 | Inoue et al. | 251/5 X |
| 3,823,562 | 7/1974 | Bacmanak | 61/53.52 X |
| 3,861,157 | 1/1975 | Hillen | 61/63 |
| 3,925,998 | 12/1975 | Le Corgne | 61/53.64 |

FOREIGN PATENT DOCUMENTS

| | | | |
|---|---|---|---|
| 944967 | 4/1974 | Canada | 61/53.64 |

*Primary Examiner*—Mervin Stein
*Assistant Examiner*—David H. Corbin
*Attorney, Agent, or Firm*—Meyer, Tilberry & Body

[57] ABSTRACT

A concrete feeding tube, hereinafter referred to as a "tremie tube", is used to feed concrete grout or the like underwater. This tremie tube consists of an outer tube having desired rigidity and a number of through-holes, and an inner tube having desired pliability, the lower end of the inner tube being adapted to be closed with a closure means. The tremie tube is so designed as to be lowered vertically into a body of water with the lower end of the inner tube being closed with the closure means. So lowered, water is introduced through the aforesaid through-holes inwardly of the wall of the outer tube so as to collapse the inner tube with a resulting decrease in buoyancy of the tremie tube. When the lowered end of the outer tube reaches the water bed then fresh hardening-material, such as concrete grout, is fed into the inner tube under pressure so as to inflate the inner tube. The closure means is opened due to the pressure of concrete being fed therein thus allowing the concrete grout to be placed on the water bed.

1 Claim, 29 Drawing Figures

TREMIE TUBE

BACKGROUND OF THE INVENTION

This invention relates to a tremie tube for use in feeding underwater hardening materials, such as concrete grout, asphalt, or the like for the work of underwater construction, such as underwater foundations and piers of bridges.

DESCRIPTION OF THE PRIOR ART

Prior art tremie tubes for feeding concrete grout underwater comprise iron tubes leading from suitable pumps. These tubes have sufficient rigidity, that the walls of the tubes do not yield to underwater pressure when the tubes are lowered to the bottom of a body of water, with the lower ends of the tubes being closed and with the tops of the tubes projecting above the surface of the water. However, rigidity of these tubes have created many problems.

In general, it is desirable when placing a second charge or course of fresh concrete grout under the water that water not be permitted to wash away the cement in the first course. When this occurs an interface of sand and gravel is created which weakens or destroys the bond between adjacent courses. To solve this problem a bottom-closure type tremie tube has been proposed to minimize the washing of water out of the tube. It is also important that the lower end of the tremie tube be embedded into the prior poured bed of concrete. With the bottom-closure type tremie tube, the tube is sunk with its lower end being closed tightly, so that fresh concrete grout will not be diluted by water coming into the lower end of the tube. When the tube is fully filled with fresh concrete grout, the closure at the lower end of the tube is opened so as to permit continued feeding of fresh concrete grout. This type of tremie tube must be weighted in order to be lowered in the water because the specific weight of the tremie tube is less than that of water. However, the attachment of weights is a hindrance to efficient use of a tremie tube.

In the case of a plunger type prior art tremie tube, the tube is sunk to the bottom of the body of water, with its lower end kept open to avoid the buoyancy problem. Thereafter, a plug or plunger is loosely inserted into the top end of the tremie tube and fresh concrete is fed onto the plunger. The weight of concrete on the plunger forces the plunger downwardly through the tube forcing water within the tube out of the lower end of the tube followed by discharge of fresh concrete.

Fresh concrete can be poured underwater with these prior art tremie tubes. However, these prior art tremie tubes create several problems, if for some reason or another the tremie tube is withdrawn from the concrete already poured with the feeding of concrete being interrupted.

First, upon interruption of feeding of concrete, there is left within a tremie tube concrete of a height 'h', wherein $$h = (P^w/P^c) \cdot H$$

$P^w$ : specific gravity of ambient water $P^c$ : specific gravity of concrete $h$ : height of concrete as measured from the surface of poured concrete, to the top surface of concrete left within the tremie tube H : depth from the surface of water down to the surface of the poured concrete.

Second, when the tremie tube is drawn from freshly poured concrete, there takes place a Rayleight-Taylor type unstable condition, due to the specific gravity of concrete being greater than that of water. The concrete left within the tremie tube will drop through the tube, whereupon water makes ingress into the tremie tube to fill the void created when the concrete leaves the tube. The replacement of concrete by water takes place so rapidly that water sometimes is jetted upwards through the hopper connecting the top end of the tremie tube. According to this phenomenon, concrete within the tremie tube and the concrete on the top surface of the freshly poured concrete, are vigorously agitated with turbulent water, causing the cement to be washed away, thereby leaving a residue of gravel and sand. This interface of gravel and sand results in imperfect bonding between adjacent consecutive pours of concrete.

Third, since the interior of the tremie tube is filled with water according to the aforesaid phenomenon, the concrete pouring operation should not be continued, since this would result in forcing water from the tremie tube into the previously poured concrete. As a result, it is necessary to dry dock the tremie tube for the purpose of draining and securing a water-tight bottom closure at the lower end of the tremie tube.

With either prior art tremie tube, plunger type or bottom closure type, the foregoing problems cause defective concrete pouring, once the tremie tube is withdrawn from contact with a course of previously poured concrete. Accordingly, it is imperative that a tremie tube not be lifted from unhardened freshly poured concrete during a subsequent pouring operation. However, in practical operation this frequently occurs albeit inadvertently. It is particularly true in the case of a crane boat with a tremie tube being suspended therefrom which is pitching and rolling, due to natural waves or waves created by the passage of other boats. This causes the tremie tube to be withdrawn from a pile of unhardened previously poured concrete, thereby causing the aforesaid operational problems.

The tremie tube, according to the present invention, is of such a construction that concrete is fed through an inner tube which is collapsible when subjected to water pressure. When the feeding of concrete is interrupted, the concrete on its way to the exit of the inner tube will be all discharged therefrom, leaving a flat inner tube. As a result, even in case the tremie tube is withdrawn from a charge of previously poured concrete, there will be no formation of gravel or sand since water cannot enter the inner tube. As a consequence, intermittent pouring operations may be made on top of previously poured concrete without the necessity of withdrawing and dry docking the tremie tube between pours.

Thus, it is clear from the foregoing exposition, the tremie tube according to the present invention obviates the shortcomings experienced with prior art tremie tubes.

It is accordingly an object of the present invention to provide a tremie tube which may readily be lowered into a body of water due to its reduced buoyancy, and also insure satisfactory concrete pouring, even if the tremie tube is withdrawn from a course of previously poured fresh concrete.

It is another object of the present invention to provide a tremie tube which will prevent ingress of gravel and sand into the inner tube, but will allow passage of ambient water through the holes of the wall of an outer tube and hence prevent accumulation of gravel and sand between the inner tube and the outer tube.

It is a further object of the present invention to provide a tremie tube having a closure means adapted to be actuated at the lower end of the inner tube when the inner tube is expanded due to concrete being filled therein.

It is a still further object of the present invention to provide a tremie tube which does not allow ingress of ambient water from the lower end of the tube therein, even if the lower end of the tube is withdrawn from a course of freshly poured concrete.

It is a yet further object of the present invention to provide a tremie tube which permits rapid concrete pouring without causing water to mix with concrete even if intermittent feeding of concrete is conducted.

It is a further object of the present invention to provide a tremie tube, which has a closure means at its lower end, the closure means being adapted to be opened by the weight of concrete grout, when fed into the inner tube, and to be automatically closed when feeding of concrete is stopped and the concrete remaining in the tube at that time has been discharged from the tremie tube.

It is a further object of the present invention to provide a tremie tube, in which the closure means affixed to the lower end of the tube will not be damaged, and the inner tube will not be misformed, even in the case of impingement of other obstacles thereupon in the course of travel of the tremie tube.

It is a further object of the present invention to provide a tremie tube, in which the closure means is adapted to open the lower end of the inner tube when concrete is being poured into the inner tube, as well as to close the lower end of the inner tube when the pouring of concrete is interrupted and the tremie tube is withdrawn from a course of freshly poured concrete.

It is yet a further object of the present invention to provide tremie tube closure means which may be operated from the surface of the water.

The foregoing objects, and others, will in part be obvious and in part pointed out more fully hereinafter in conjunction with the written description of preferred embodiments shown in the accompanying drawings in which.

Figure 7:
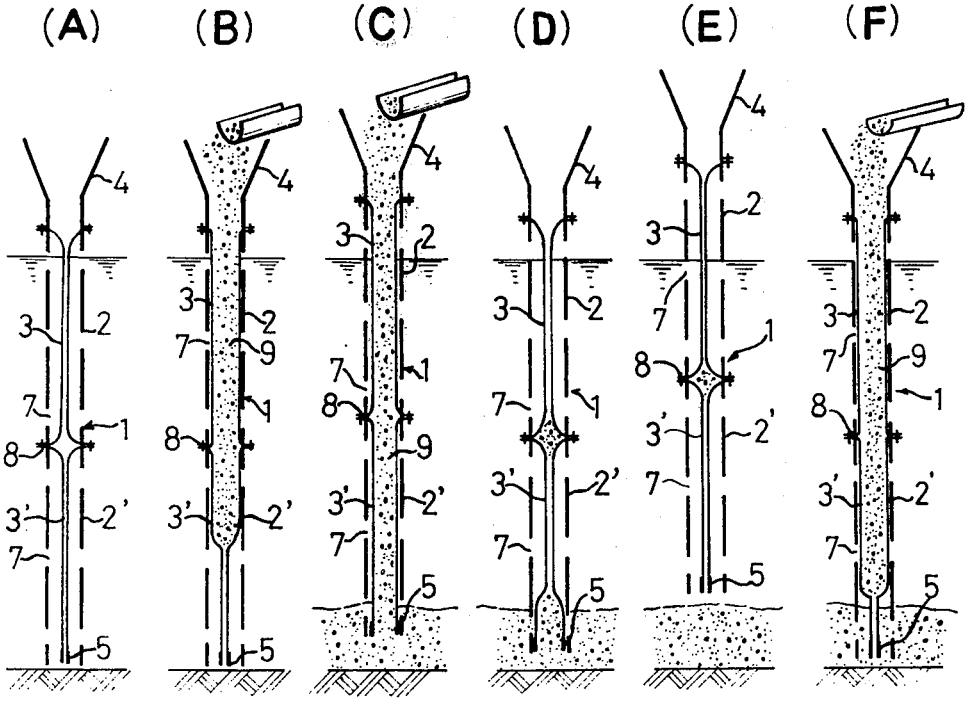
Figure 8:
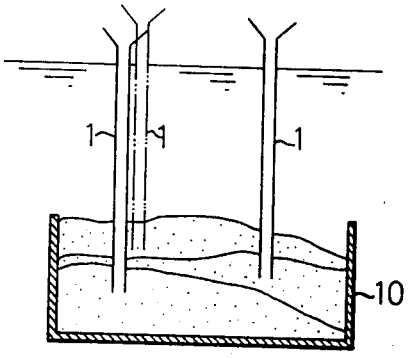
Figure 9:
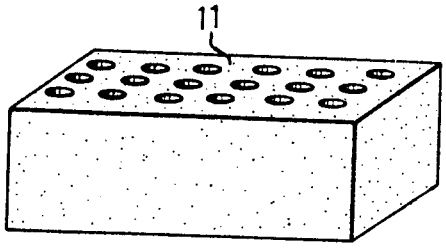
Figure 10:
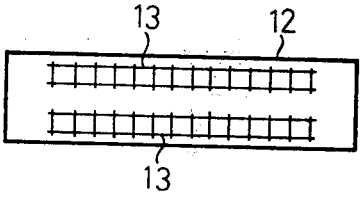
Figure 11:
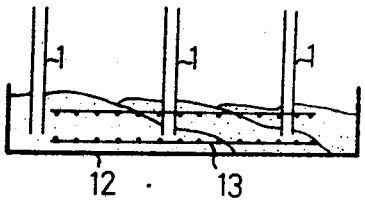
Figure 12:
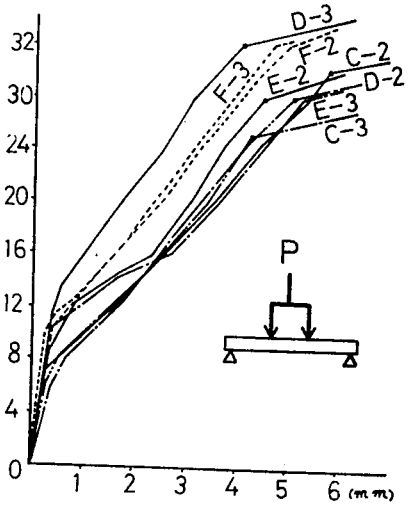
Figure 13:
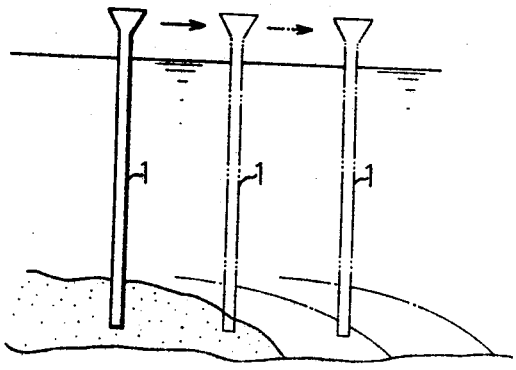
Figure 14:
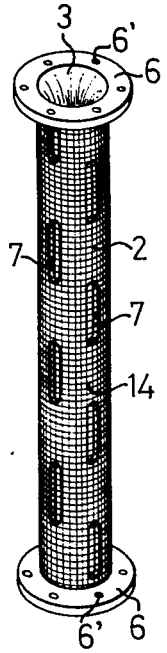
Figure 15:
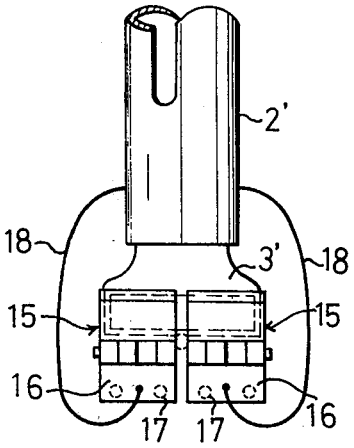
Figure 16:
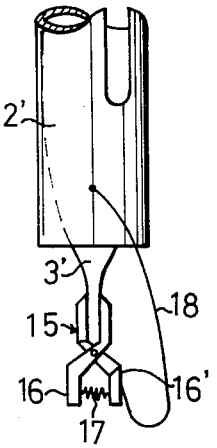
Figure 17:
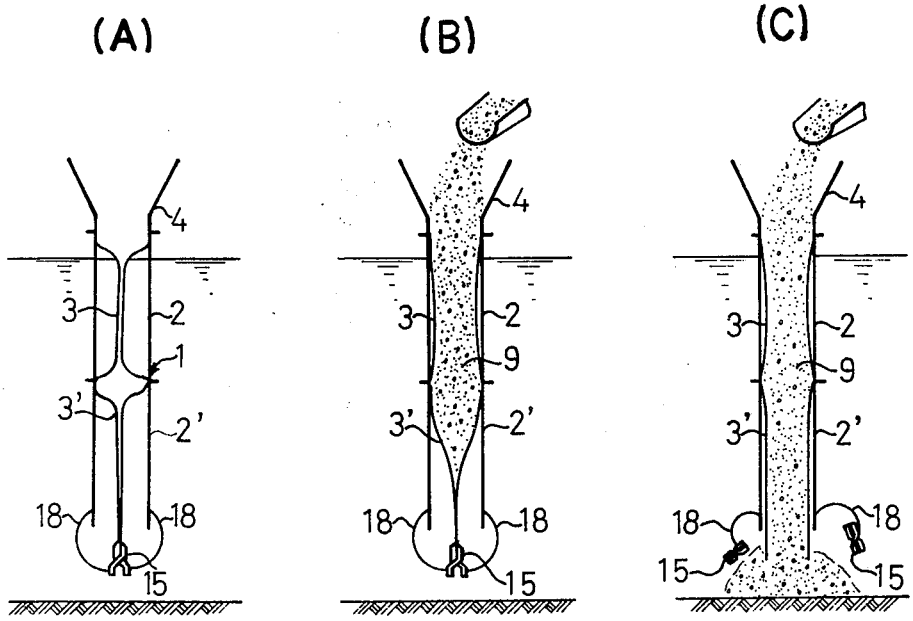
Figure 18:
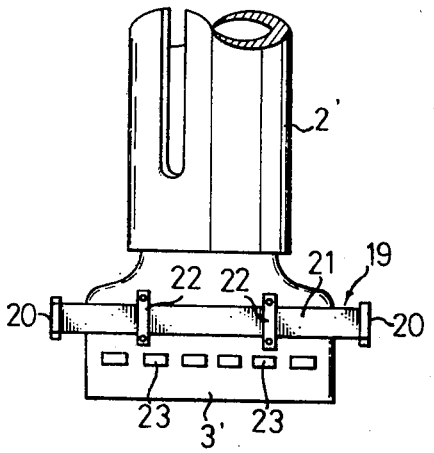
Figure 19:
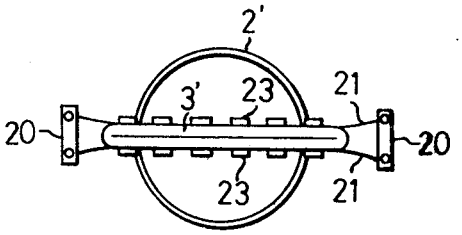
Figure 20:
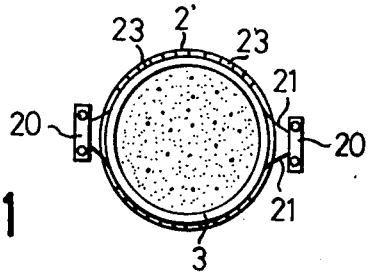
Figure 21:
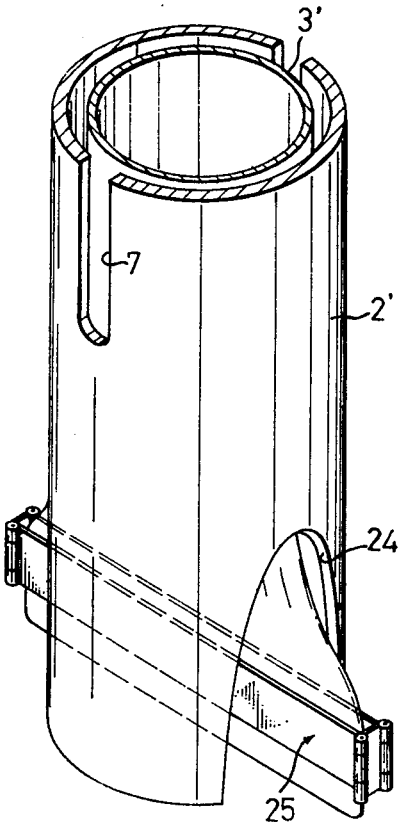
Figure 22:
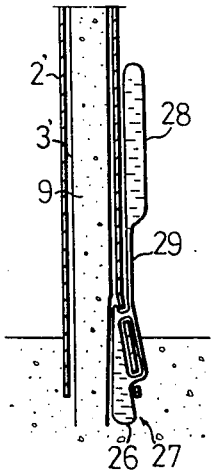
Figure 23:
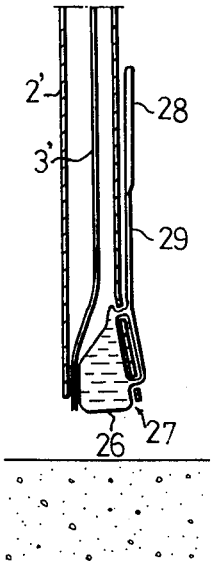
Figure 24:
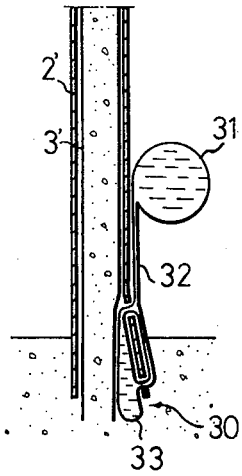
Figure 25:
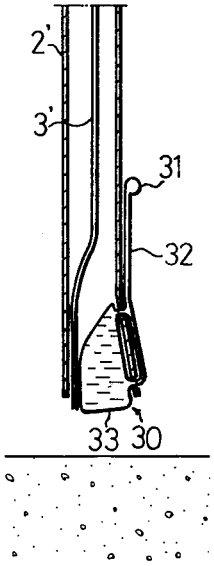
Figure 26:
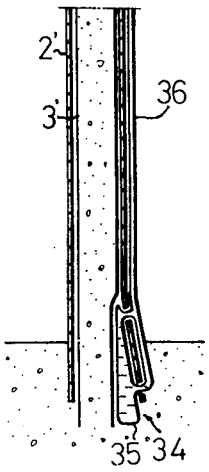
Figure 27:
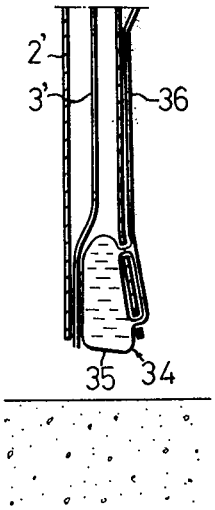
Figure 28:
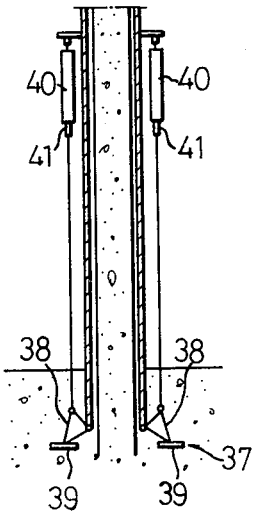
Figure 29:
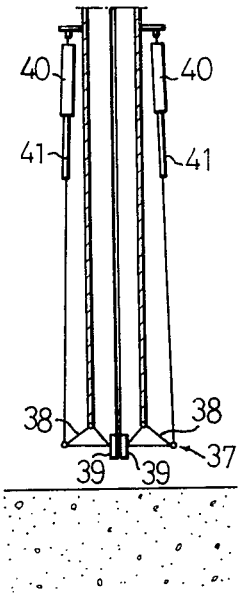

FIGS. 7 (A), (B), (C), (D), (E), (F) are elevational views in section illustrative of a procedure of pouring concrete underwater through the tremie tube according to the present invention;

FIG. 8 is an elevational view in section illustrative of the procedure of pouring concrete underwater into a mold used in the tests made to confirm the advantages of the tremie tube according to the present invention;

FIG. 9 is a perspective view illustrative of a sample block prepared according to the procedure of FIG. 8;

FIG. 10 is a plan view illustrative of the arrangement of reinforcing bars to be buried in underwater concrete in the tests made to confirm the advantages of the tremie tube according to the present invention;

FIG. 11 is a cross-sectional view illustrative of the procedure of pouring concrete underwater into a mold, in which reinforcing bars are buried;

FIG. 12 is a plot showing the relationship between loads on reinforced concrete beams prepared according to the underwater concrete pouring procedure of FIG. 11;

FIG. 13 is an outline of a cross-sectional view illustrative of the sequential placing of concrete by the use of a tremie tube according to the present invention;

FIG. 14 is a perspective view of an outer tube member having a mesh which covers through-holes;

FIG. 15 is a fragmentary elevational view showing the lower part of the subject tremie tube, in which a closure means such as a pair of pincers type squeezing or clamping members are affixed to the inner tube;

FIG. 16 is a side view of FIG. 15;

FIGS. 17 (A), (B), (C) are vertical views in section illustrative of the procedure of pouring concrete by the use of a tremie tube having an inner tube with the securing closure means of FIG. 15;

FIG. 18 is a fragmentary elevational view of the lower part of a tremie tube having a closure means consisting of a pair of plate springs which are secured to the lower part of an inner tube projecting from the lower end of an outer tube;

FIG. 19 is a bottom view of FIG. 18;

FIG. 20 is a bottom view of a tremie tube showing the inner tube closure means expanded by concrete being poured therethrough;

FIG. 21 is a fragmentary perspective view illustrative of the lower part of a tremie tube having a closure means attached to the lower part of an inner tube housed in an outer tube;

FIG. 22 is an elevational view in section showing a tremie tube in which a first resilient bag is positioned in a slightly enlarged lower portion of an outer tube in communication with a second resilient bag at a level higher than that of the first bag, while liquid having a specific gravity greater than that of water is filled within the two bags to operate as closure means on the inner tube when concrete is not being poured therethrough;

FIG. 23 is an elevational view in section of a tremie tube showing a closed condition of an inner tube using the closure means of FIG. 22;

FIG. 24 is an elevational view in section of a tremie tube having a closure means in which a first resilient bag is placed in a slightly enlarged lower part of the outer tube, and a second resilient bag is installed outside of the outer tube, with the first bag being in communication with the second bag, while liquid with a specific gravity greater than water is in communication between two bags to function as a closure means similar to the means of FIG. 22;

FIG. 25 is an elevational view in section of a tremie tube showing a closed condition of the inner tube using the closure means of FIG. 24;

FIG. 26 is an elevational view in section of a tremie tube having a closure means, in which a resilient bag is placed in a slightly enlarged lower part of an outer tube, with a hose connected thereto for permitting egress of fluid from the bag, whereby the inner tube is permitted to open when concrete grout is pressed therethrough;

FIG. 27 is an elevational view in section of a tremie tube showing a closed condition of an inner tube using the closure means of FIG. 26;

FIG. 28 is an elevational view in section showing an open condition of the inner tube having a closure means consisting of a pair of plates adapted to sandwich the lower part of the inner tube, the plates being adapted to be spread apart by means of a fluid pressure cylinder; and, FIG. 29 is an elevational view in section of a tremie tube showing a lifted condition of the tube using the closure means of FIG. 28.

Figure 1:
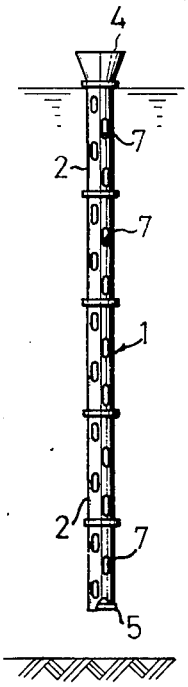
FIG. 1 is an elevational view of a preferred embodiment of the subject tremie tube which has been lowered into a body of water.
Figure 2:
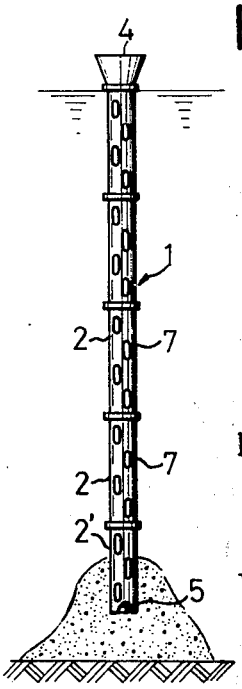
FIG. 2 is an elevational view of a preferred embodiment of the subject tremie tube, showing it positioned to pour concrete.
Figure 3:
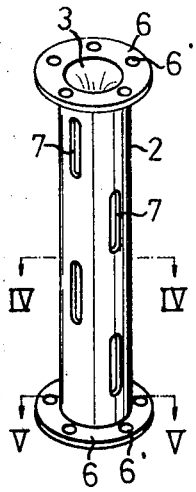
FIG. 3 is a perspective view of an outer tube member of the subject tremie tube, excluding the lowermost portion of the tube.

Referring now to the drawings in greater detail, a tremie tube 1, as shown in FIG. 1, consists of an outer tube composed of a plurality of outer tube segments 2 coupled to each other along the length thereof, an inner tube composed of a plurality of inner tube segments, FIG. 7(A), 3 which are respectively tied to adjacent outer tube segments, a hopper 4 secured to the top end of the uppermost tube segment and a closure means 5 coupled to the lower end of the lowermost inner tube segment 3.

Figure 6:
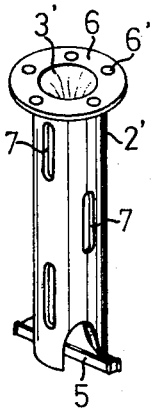
FIG. 6 is a perspective view of an outer tube member constituting the lowermost part of an outer tube of the tremie tube.
Figure 4:
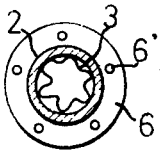
FIG. 4 is a cross-sectional view taken along the line IV—IV of FIG. 3.
Figure 5:
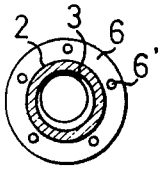
FIG. 5 is a cross-sectional view taken along the line V—V of FIG. 3.

The outer tube segment 2, FIG. 3, is formed with a pair of flanges 6 at its opposite ends, and these flanges 6 each have several bolt holes. A plurality of through-holes 7 are provided in the wall of each outer tube 2. The unit inner tube 3 is made of a resilient material such as pliable synthetic resin sheet or rubber sheet, with the opposite ends of the tube 3 tied to the outer tube ends. When pressure is applied to the inner tube, it is deflated, with its inner surfaces being brought into contact with each other. The lowermost outer tube segment 2' of the tremie tube 1 is not provided with a flange at its lower end, as shown in FIG. 6, while the lower end of the inner tube segment 3' within the outer tube segment 2' is not secured thereto.

Both the outer tube segments 2, 2' and the inner tube segments 3, 3' are coupled to each other by means of flanges 6,6 and bolts 8 which are inserted into the bolt holes 6' for fastening the flanges 6,6 together.

The closure means 5, formed of elastic squeezing members, normally closes the lower end of the inner tube segment 3' but is adapted to open under the pressure of concrete grout being poured through the inner tube.

FIG. 7 shows, in the order of the steps, the process for pouring concrete on the bed of a waterway with the subject tremie tube. FIG. 7(A) illustrates the condition where the tremie tube 1 has been submersed with paste filled in the lower part of the inner tube segment 3' of the tube 1. Since the respective inner tubes 3, 3' are collapsed under the water pressure, the filling of paste at the lower end of the inner tube 3' prevents ingress of water therein. In addition, a decrease in inner volume of the tremie creates a decrease in buoyancy, so that the tremie tube 1 may be lowered by its own weight. FIG. 7(B) shows the condition where a hardening material 9 such as concrete grout, motar, asphalt or the like is fed into the tremie tube. The inner tube segments 3, 3' are filled with inflowing concrete grout so that water present between the outer tube segments 2, 2' and the inner tube segments 3, 3' is forced out from through-holes 7.

FIG. 7(C) illustrates the condition of the concrete 9 being poured on the bed of the body water. The closure means 5 at the bottom end of the inner tube is opened under the pressure of the concrete 9 charged therein, so that the concrete flows out the bottom end of the inner tube.

FIG. 7(D) shows the condition where feeding of concrete 9 has been ceased. Upon interruption of feeding of concrete grout 9, most of the concrete grout in the inner tube flows down through the inner tube, after which the inner tube segments 3, 3' will collapse under water pressure. As a result, the hardening material of a height of $h = (P^w/P^c : H$ will not be left therein, as would be the case with prior art tremie tubes.

FIG. 7(E) shows the condition where the tremie tube has been withdrawn from a deposit of freshly poured concrete. As shown, the inner tube segment 3' becomes flat, with no concrete left therein. Furthermore, there is no surge of water into the tremie tube to fill the void caused by the discharging concrete. As a consequence there is no dilution of the concrete to form gravel and sand due to the loss of cement. In addition, the closure means 5 completely closes the lower end of the inner tube segment 3', eliminating the possibility of the inner tube 3' being opened due to wrinkles of its wall, and hence the accompanying introduction of water therein.

FIG. 7(F) illustrates the condition wherein the tremie tube 1 which has been once withdrawn from a deposit of poured concrete is again embedded therein for the continued pouring of concrete. The inner tube segments 3, 3' are not filled with water therein, so that unlike the prior art plunger type tremie tube, there is no possibility that water in the tube will be forced into a deposit of already poured concrete.

FIGS. 8 and 9 and Table 1, infra, show the results of tests, which confirm the advantages of the tremie tube 1 according to the present invention. More specifically, FIG. 8 illustrates the tests undertaken to verify the improvements of the tremie tube according to the present invention. In these tests, four molds 10, 3–4 m long, 1 m wide and 1 m high, were lowered to the bottom of a bed of water at a depth of about 10 m. About one-third of each mold was filled with concrete with the tremie tube at position (A). The tremie tube 1 was withdrawn from the first poured concrete and shifted to position (B), where another one-third of the mold was filled with concrete. Finally, the tremie tube 1 was shifted to position (C) and the remaining one-third of the concrete was poured. After hardening, the block of concrete was lifted from the water and 6 cores were taken from the concrete sample block 11, FIG. 9, for compression tests.

The test results are shown in Table 1 below:

Table 1

| Sample Block NO | Amount of Concrete per Sample | No. | Core Strength | Variation Factor | Average Strength of Standard Sample Block |
|---|---|---|---|---|---|
| 1 | 370 | 84 | 363 | 17.2 | 334 |
| 2 | 370 | 72 | 302 | 13.8 | 328 |
| 3 | 320 | 90 | 234 | 8.5 | 240 |
| 4 | 270 | 85 | 197 | 12.0 | 200 |

Despite the fact that the tremie tube was withdrawn from freshly poured concrete and then re-embedded two times, there were no observed striations of gravel and sand in the test cores of sample blocks 11. The test cores were of concrete of a quality equivalent to that of normally prepared concrete strength cores.

FIGS. 10 and 11 illustrate the tests which were given for the purpose of proving the advantages of the tremie tube according to the present invention.

FIG. 10 illustrates the arrangement of reinforcing bars of reinforced concrete placed by the use of a tremie tube according to the invention. In this test, reinforcing bars 13 were placed in three molds 12, 90 cm wide, 4.5 m long and 90 cm high, and then the molds 12 were lowered to the bottom of a body of water at a depth of about 10 m. Then, as shown in FIG. 11, concrete was placed into these molds 12 by twice repeating a cycle of withdrawal and insertion of the tremie tube according to the present invention. The molds were then recovered, after which each sample block was split into two lengthwise to obtain six reinforced concrete beams. FIG. 12 is a plot showing the results of load tests of these six reinforced concrete beams plus two other beams which were prepared in the normal manner for test purposes. Alghough the six sample beams exhibit slightly high deflection, despite the fact that the tremie tube was subjected to a repeated cycle of withdrawal and insertion of the tremie tube, these six sample beams tested to the same load carrying ability as that of the normally prepared concrete test beams prepared on land, i.e., they sustained a load carrying ability sufficiently higher than a defined allowance load of 12.5 tons.

FIG. 13 shows the condition where concrete is placed over a wide area of the bottom of a waterway, by repeating a cycle of withdrawal and insertion of a single tremie tube which is moved so as to cover the whole area of the bottom.

FIG. 14 shows the tremie tube encased in a mesh jacket, such as wire, and attached to the wall of outer tube segment 2, in a manner to cover the through-holes 7. When concrete is fed intermittently into a tremie tube, floating debris, as well as gravel or sand contained in the concrete which spills off of the hopper 4, will be introduced through the holes 7 into between the outer tube and the inner tube, which then tend to accumulate therebetween. In time this accumulation compresses the inner tube and interferes with unrestricted pouring of the concrete. The mesh member 14 tends to retard this occurrence.

FIGS. 15 to 29 show detailed examples of various types of closure means 4.

A closure means 15 of a pincers type, as shown in FIGS. 15 and 16, consists of two cross or clamping members 16, 16' hinged to each other at their mid points, with a spring 17 confined between a pair of legs of the clamping members, so that the opposing tops of the clamping members 16, 16' clamp the lower end of a unit inner tube 3' therebetween under the action of the spring 17. In this manner, the closure means 15 is secured to the lower end of the unit outer tube 2'.

FIGS. 17 (A), (B), (C) illustrate the use of a closure means 15. More particularly, the lower end of the tube segment 3', shown in FIG. 17(A), is clamped by means of the closure means 15, with a viscous water resistant material applied to the inner surfaces of the lower end of the unit inner tube 3', preferably, after which the tremie tube 1 is lowered into the water. Then, the unit inner tubes 3, 3' collapse under water pressure, with the result that water finds its way into the inner tubes 3, 3'. Subsequently, concrete grout 9 is poured into the inner tube. The inner tube members 3, 3' will be inflated due to the pressure of the concrete passing therethrough, as shown in FIG. 17(B). As a result of the pressure of the concrete, the closure means 15 releases the lower end of the inner tube segment 3', as shown in FIG. 17(C), thus allowing the concrete to flow out therefrom.

FIG. 18 shows a closure means 19 having a pair of plate springs 21, the opposite ends of which are secured to connecting members 20, respectively, thereby clamping the lower end of the inner tube segment 3'. The plate springs 21 are fastened to the inner tube segment 3' by holders 22, the opposite ends of which are secured to the inner tube segment 3'. As shown in FIG. 19, the lower end of the inner tube segment 3' is clamped into a flat condition under the action of plate springs 21. In addition, the lower end is assisted in being held closed with the aid of an attracting force of a plurality of magnets 23 affixed to the outer periphery of the lower end of inner tube segment 3'. FIG. 20 illustrates the inner tube segment 3' when filled with concrete. The plate springs 21 are deflected into an arcuate shape under the pressure of the concrete 9, so as to open the lower end of the inner tube segment 3'. When the concrete 9 ceases to flow out of the inner tube, the lower end of the inner tube 3' will be automatically closed by the plate springs 21, assisted thereafter by magnets 23.

FIG. 21 shows the outer tube segment 2', whose lower end is formed with a pair of opposing cuts 24, to receive closure means 25 which project therethrough. The arrangement shown in FIG. 21 is designed to protect the closure means 25 from damage during operations, such as transportation, assembly, sinking, and the like, of the tremie tube acsording to the invention.

FIG. 22 illustrates an embodiment of the invention in which the lower end of the outer tube segment 2' is enlarged so that a soft or resilient bag 27 made of synthetic resin or the like is placed between the inner surface of the outer tube segment 2' and the outer surface of the inner tube segment 3'. Another soft bag 28 similar thereto is positioned above but outside the outer segment tube 2', with the bag 27 in communication with the bag 28 by means of a pipe 29. Liquid of a specific gravity greater than that of water is placed in the bag 27 in an amount which will enlarge the bag 27 sufficiently to close the inner tube segment 3'. A suitable liquid is an aqueous solution containing 40 to 50% of NaI, $FeCl_2$, $K_2CO_3$ or $CdCl_2$. FIG. 22 illustrates a pouring operation wherein bag 27 is collapsed under the pressure of the concrete. Liquid of a specific gravity greater than that of water is forced from the bag 27 to the bag 28 to open segment tube 3'. FIG. 23 illustrates the condition where the tremie tube 1 has been lifted up from a layer of freshly poured concrete. The liquid, having a specific gravity greater than that of water, descends to inflate the bag 27, thereby urging the lower end of the inner tube segment 3' against the inner surface of the outer tube segment 2'.

FIG. 24 illustrates closure means 30 similar to that of FIG. 22, except that a resilient bag 31 is used in place of the bag 28. The contracting and restoring force of the bag 31 is transferred by way of a pipe 32 into a bag 33 so as to swell the bag 33, so that the lower end of the inner tube segment 3' is urged against the inner surface of the outer tube segment 2', thereby closing same. FIG. 24 shows the condition wherein concrete 9 is being fed into the inner tube, with the lower end of the inner tube segment 3' being kept open in the same manner as in FIG. 22.

FIG. 26 illustrates a closure means 34 wherein the bag 35 is connected to a source of liquid through a pipe 36. Liquid is supplied from above the surface of the water through the pipe 36 into the bag 35 to close inner tube segment 3'. Conversely, transfer of liquid from the bag 35 through pipe 36 to any suitable holding means, such as a tank or the like, permits the lower end of the inner tube segment 3' to open.

FIG. 28 illustrates a closure means 37 consisting of a pair of levers 38 of triangular configuration, with one apex of each lever 38 pivoted to the wall of the outer tube, and with another apex provided with clamping of squeezing plates 39. The remaining apex is tied to an extendable rod 41 of a hydraulic cylinder 40. FIG. 28 shows the condition wherein concrete 9 is traveling down through the inner tube, at which time rods 41 are retracted into the cylinders 40 so as to spread the opposing clamping plates 39 to open inner tube segment 3'. FIG. 29 shows the tremie tube 1 lifted up from the poured concrete. The rods 41 are extended so as to bring the clamping plates 39 into their closed position, thereby closing the lower end of the inner tube segment 3'. Other embodiments of the invention, and other modifications of the preferred embodiments will be apparent to those skilled in the art upon reading the foregoing description of the preferred embodiments. Accordingly, it is to be distinctly understood that the foregoing descriptive matter is to be interpreted merely as illustrative of the present invention and not as a limitation.

What is claimed is:

1. A tremie tube comprising: a first rigid outer tube having an enlarged lower end; a second water impervious, pressure yieldable inner tube secured within said outer tube; a pressure responsive closure means secured to the lower end of said inner tube; means to pressure actuate said closure means; said pressure responsive closure means including an expandable bag hydraulic valve means positioned within said enlarged portion of the lower end of said first outer tube; and means for providing ingress and egress of a bag expandable substance into and out of said expandable bag including a third tubular member with one end in communication with said expandable bag hydraulic valve means and with the other end adjacent the upper end of said first rigid outer tube adapted to receive said bag expandable substance for transmission through said third tubular member to and from said expandable bag hydraulic valve means, wherein said expandable bag hydraulic valve means functions as a hydraulic valve to open and close the lower end of said second tube responsive to pressure inducing substance transmitted through said third tubular member.

* * * * *

UNITED STATES PATENT AND TRADEMARK OFFICE

CERTIFICATE OF CORRECTION

PATENT NO. : 4,129,008

DATED : December 12, 1978

INVENTOR(S) : Yasushi Nakahara, Tadasuke Ohtomo, Shinichi Yokota, Kazuo Usui

It is certified that error appears in the above-identified patent and that said Letters Patent are hereby corrected as shown below:

In the drawings, Sheet 2, Figure 8, the reference letters A, B and C should be applied to designate by arrows the lowermost, mid-elevational and uppermost positions, respectively, of the tremie tube 1. Column 5, line 62, "motar" should read -- mortar --. Column 6, line 11, after the equal sign "=" delete the parenthesis mark -- ( --. Column 7, line 16, "Alghough" should read -- Although --. Column 8, line 27, "acsording" should read -- according --. Column 9, line 6, "of" should read -- or --.

Signed and Sealed this

*Thirteenth* Day of *November 1979*

[SEAL]

*Attest:*

RUTH C. MASON
*Attesting Officer*

LUTRELLE F. PARKER
*Acting Commissioner of Patents and Trademarks*